US005348360A

United States Patent [19]

Mencarelli et al.

[11] Patent Number: 5,348,360

[45] Date of Patent: Sep. 20, 1994

[54] REPLACEABLE CUSHIONED CONTOURED GRIPPING DEVICE FOR THE HANDLE OF A TOOL

[76] Inventors: Albert E. Mencarelli; Richard A. Mencarelli, both of 1050 E. Lake Rd., Oakdale, Conn. 06370

[21] Appl. No.: 107,915

[22] Filed: Aug. 17, 1993

[51] Int. Cl.[5] ..... B25G 1/10

[52] U.S. Cl. ..... 294/57; 16/114 R; 16/116 R; 74/551.9

[58] Field of Search ..... 294/25, 57, 58, 137, 294/171; 16/110 R, 111 R, 114 R, 116 R, 125, DIG. 12, DIG. 19; 74/551.9; 273/75, 81 R, 81.2, 165

[56] References Cited

U.S. PATENT DOCUMENTS

| | | | |
|---|---|---|---|
| 2,701,379 | 2/1955 | Balistreri | 16/16 R X |
| 2,984,486 | 5/1961 | Jones | 273/81.2 X |
| 3,368,811 | 2/1968 | Finney | 294/25 X |
| 3,585,101 | 6/1971 | Stratton et al. | 16/111 R X |
| 3,981,043 | 9/1976 | Curry | 294/57 X |
| 4,051,553 | 10/1977 | Howard . | |
| 4,053,676 | 10/1977 | Kaminstein | 16/110 R X |
| 4,284,275 | 8/1981 | Fletcher | 273/75 |
| 4,567,091 | 1/1986 | Spector | 273/81.5 X |
| 4,754,858 | 7/1988 | Robinson . | |
| 4,785,495 | 11/1988 | Dellis | 74/551.9 X |
| 4,850,502 | 7/1989 | Davis | 294/137 X |
| 4,890,355 | 1/1990 | Schulten | 294/171 X |
| 4,893,369 | 1/1990 | Johnson . | |
| 4,941,232 | 7/1990 | Decker et al. | 74/551.9 X |
| 4,977,621 | 12/1990 | Richard . | |
| 4,981,737 | 1/1991 | Rico | 74/551.9 X |
| 5,023,128 | 6/1991 | Fatool . | |

FOREIGN PATENT DOCUMENTS

| | | | |
|---|---|---|---|
| 641210 | 1/1937 | Fed. Rep. of Germany | 294/57 |

*Primary Examiner*—Johnny D. Cherry
*Attorney, Agent, or Firm*—Albert W. Hilburger

[57] ABSTRACT

A cushioned gripping device is provided for attachment to the elongated handle of a tool. It includes a pad of foam-like resilient material dimensioned to substantially encircle the handle of the tool and to extend along a substantial length of the handle. The pad can be mounted by means of a layer of pressure sensitive adhesive material in which instance, a releasable backing sheet may overlie the layer of adhesive material. A resilient sheet of rubber-like material may overlie the pad to extend the life of the foam-like material. In another instance, the device may be attached by means of hook and loop material. In another embodiment, the device may have a contoured outer surface to improve the ability of a person to maintain a grip. Also, the device may be tubular and cut longitudinally for reception on the handle of the tool. Yet again, the device may be generally planar and rectangular, having a width dimension generally equal to the outer periphery of the handle.

10 Claims, 1 Drawing Sheet

REPLACEABLE CUSHIONED CONTOURED GRIPPING DEVICE FOR THE HANDLE OF A TOOL

BACKGROUND OF THE INVENTION

1. Field of the Invention

The present invention relates generally to a cushioned gripping device for selective attachment to the elongated handle of a tool. It serves to improve the ability of a person to maintain a grip on the tool while cushioning the user's hand and providing protection against abrasion.

2. Description of the Prior Art

The use of hand tools such as shovels, rakes, pitch forks, brooms, lawn mowers, axes, and the like, for an extended period of time can cause difficulties for the user. For example, perspiration can cause the user's hands to slip on the handle of the tool. Blisters are also likely to develop and nerve damage to the finger tips can occur. A malady sometimes referred to as "white finger nerve damage" can occur when vibrating hand held equipment is used. If gloves are worn, they can cause fatigue, are an unpleasant covering in hot, humid, weather, and can also cause slippage between the user's hands and the handle of the tool.

It has been known to provide cushioned devices to protect a user's hands when engaged in various activities. For example, U.S. Pat. No. 5,023,128 issued Jun. 11, 1991 to Fatool discloses an impact absorbing pad which includes a plurality of parallel, elongated, individually sealed hollow pneumatic tubes with coextensive webbing. In this instance, the pad is a shaped cushion which could be used as a kneeler, pillow, or for a similar purpose.

U.S. Pat. No. 4,977,621 issued Dec. 18, 1990 to Richard discloses a one-piece multi-purpose hand-cushioning device providing protection to the palm area of the hand from trauma associated with athletic and job-related activities. The pad is manufactured from die cut neoprene with a bonded nylon backing, with or without an additional bonded raised cushion in the palm area. Four finger holes are provided to eliminate the requirement for any type of fasteners.

In another instance, U.S. Pat. No. 4,893,369 issued Jan. 16, 1990 to Johnson discloses a utensil for floor cleaning and other surface treatment comprising a pad, for example, of sponge material, releasably attached by clips to the handles of a hinged holder. The handles form a grip for enabling the utensil to be held for use and also enable the hinged parts of the holder to be pressed together to squeeze the pad.

U.S. Pat. No. 4,754,858 issued Jul. 5, 1988 to Robinson discloses a cushioning pad for relieving the strain of carrying luggage. The pad is removable and attachable to a plurality of luggage pieces by means of a pair of stretchable elastic bands provided in the cushioning pad by through holes positioned at each end thereof. The cushioning pad can be used on handheld luggage as well as luggage using an over-the-shoulder strap.

U.S. Pat. No. 4,051,553 issued Oct. 4, 1977 to Howard discloses a hard foam rubber pad affixed to the back of a lightweight glove, for football. The pad extends over the knuckles of a hand inserted into the glove and is molded so as to force the fingers to naturally curl without conscious effort but allowing the fingers to be straightened with conscious effort. By curling the fingers, the probability that the fingers will be bent backward over the back of the hand with resultant injury is greatly reduced. The pad also protects the back of the hand from direct injury. Additionally, latex rubber affixed to the fingers, thumb, and palm of the glove enables an athlete to grip a ball with greater facility.

It was in light of the foregoing prior art that the present invention was conceived and has now been reduced to practice.

SUMMARY OF THE INVENTION

According to the present invention, a cushioned gripping device is provided for selective attachment to the elongated handle of a tool. It includes a pad of foam-like resilient material dimensioned to substantially encircle the handle of the tool and is elongated to extend along a substantial length of the handle. The pad can be mounted to the handle of the tool by means of a layer of pressure sensitive adhesive material on the pad and generally coextensive therewith. In this instance, a releasable backing sheet may overlie the layer of adhesive material. The backing sheet can be removed enabling the gripping device to be attached to the handle of the tool. A resilient sheet of rubber-like material may overlie the pad to extend the life of the foam-like material. In another instance, the device may be attached by means of hook and loop material having one component integral with the pad and another component capable of attachment to the handle of the tool. In another embodiment, the device may have a contoured outer surface to improve the ability of a person to maintain a grip. Also, the device may be tubular having an inner diameter substantially similar to the outer diameter of the handle of the tool and cut longitudinally to define opposed longitudinally extending edges which are drawn together into a facing proximate relationship when the pad is attached to the handle of the tool. Yet again, the device may be generally planar and rectangular, having a width dimension generally equal to the outer periphery of the handle.

A primary object of the invention is to provide a cushioned gripping device of customized size and placement for attachment to the elongated handle of a tool or other device having a handle to be gripped.

Another object of the invention is to provide such a cushioned gripping device which utilizes existing materials and is inexpensive to manufacture.

A further object of the invention is to provide such a cushioned gripping device which is re-usable.

Still another object of the invention is to provide such a cushioned gripping device which can be readily applied to a receiving surface and which will accommodate a broad range of sizes and shapes of such receiving surfaces.

Yet another object of the invention is to provide such a cushioned gripping device which is tubular shaped and longitudinally slit on one side enabling it to be opened against its resilience for reception on the handle of the tool, then to snap to a closed position tightly engaging the outer surface of the handle.

Still a further object of the invention is to provide such a cushioned gripping device which is generally of flattened construction able to be cut to conform to the size and shape of the handle to which it is to be attached.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and, together with the description, serve to explain the principles of the invention in general terms. Like numerals refer to like parts throughout the disclosure.

DETAILED DESCRIPTION OF THE PREFERRED EMBODIMENTS

Figure 1:
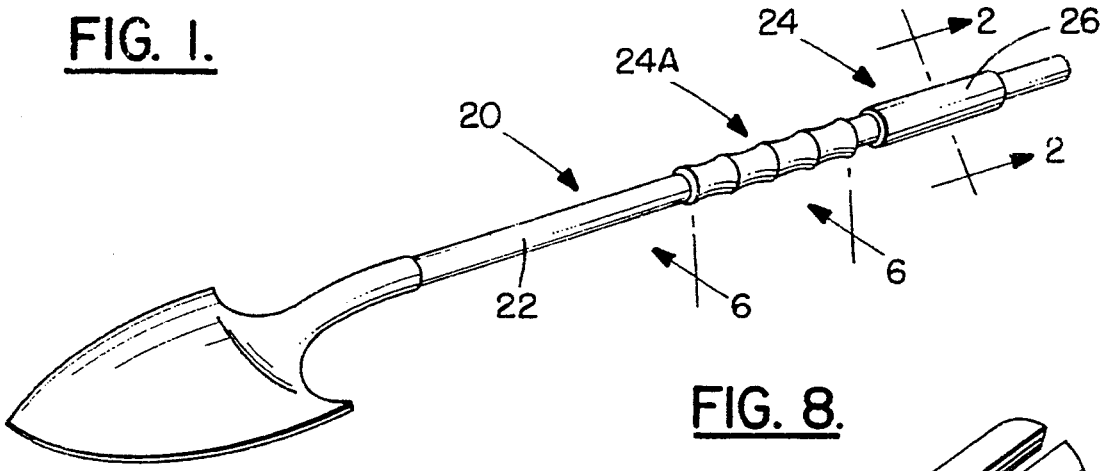
FIG. 1 is a perspective view of a hand tool to which cushioned gripping devices embodying the present invention have been attached.

Turn now to the drawings and, initially, to FIG. 1 which illustrates a hand tool 20 arbitrarily illustrated as a shovel having an elongated handle 22 to which cushioned gripping devices 24, 24A embodying the present invention are attached.

Figure 2:
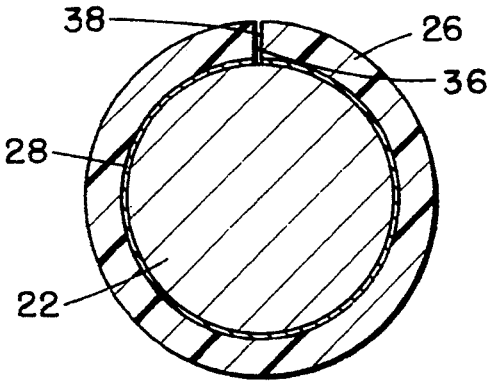
FIG. 2 is a cross section view taken generally along line 2—2 in FIG. 1.

As seen in FIG. 2, the cushioned gripping device 24 comprises a pad 26 of foam-like resilient material dimensioned to substantially encircle the handle 22 and, viewing FIG. 1, is elongated so as to extend along a substantial length of the handle. An appropriate attachment mechanism 28 is employed for mounting the pad 26 to the handle 22.

Figure 4:
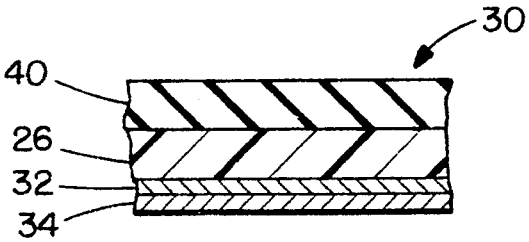
FIG. 4 is a cross section view taken generally along line 4—4 in FIG. 3.
Figure 3:
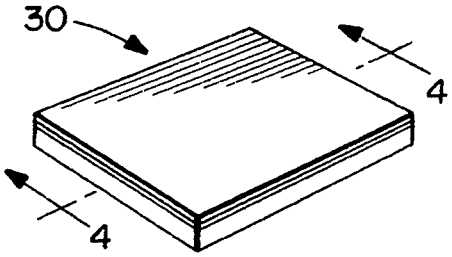
FIG. 3 is a perspective view of a sandwiched structure from which a cushioned gripping device can be fabricated.

In one embodiment, viewing FIGS. 3 and 4, the cushioned gripping device 24 may, in its initial state, be a flat planar sandwiched structure 30. It is illustrated in section at FIG. 4 which depicts a foam pad 26, an underlying layer 32 of adhesive, preferably pressure sensitive, and a customary backing sheet 34.

Figure 5:
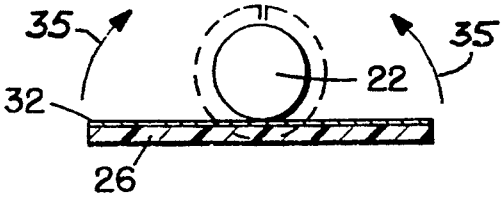
FIG. 5 is a diagrammatic end elevation view illustrating the manner of attaching a sandwiched structure to the handle of a hand tool.

Because handles 22 may be of a wide variety of sizes, shapes, and even cross sections (for example, round, square, oblong and the like), it is desirable to provide a sandwiched structure 30 having a nominal size which can, when desired, be cut to a final desired size when it comes time to apply it to a hand tool. As diagrammatically depicted in FIG. 5, for example, it could be cut by means of a scissors or suitable knife, width wise, to a dimension to assure that it would substantially encircle the periphery of the handle 22. It will be appreciated that although the handle 22 is depicted in the drawings as being round, it may actually be of any desired shape and the invention is able to accommodate that particular desired shape.

After the sandwiched structure 30 has been cut to the desired size, the backing sheet 34 is then removed as by peeling. Lacking the backing sheet 34, the remainder of the sandwiched structure, now cut to size, is properly aligned with a center line of the handle 22, then rolled (as indicated by arrows 35) onto the peripheral surface of the handle causing it to adhere to the handle by reason of the adhesive layer 32. When fully mounted, opposed edges 36, 38 (FIG. 2) are in juxtaposed position and are generally aligned with a longitudinal axis of the handle 22.

As seen in FIG. 4, the foam pad 26 of the sandwiched structure 30 may receive an overlying, contiguous, resilient sheet 40 of rubber-like material. The sheet 40 would preferably be of a tougher but less resilient material than that of the foam pad 26. A primary reason for providing the rubber-like sheet 40 is to improve the durability of the sandwiched structure 30. The rubber-like sheet 40 would be substantially more wear resistant than the foam pad 26.

Figure 6:
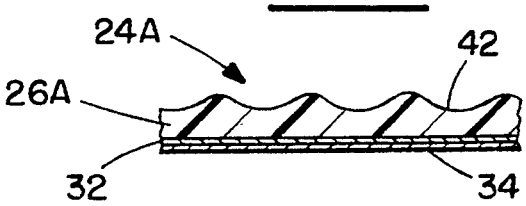
FIG. 6 is a cross section view taken along line 6—6 in FIG. 1 illustrating another embodiment of the invention.

Another embodiment of the invention is illustrated in FIG. 6 as a modified cushioned gripping device 24A. In this instance, a numeral 26A depicts a modified foam pad provided with an altered outer surface 42. The outer surface 42 may be moderately roughened so as to have undulations or other physical features which will better enable a user to grip and maintain that grip on the handle 22. Of course, it will be appreciated that if the rubber-like sheet 40 overlies the foam layer 26A, then the undulations may actually be in the rubber-like sheet and not in the underlying foam pad. In FIG. 1, the modified cushioned gripping device 24A is illustrated attached to the handle 22 of the hand tool 20.

Figure 7:
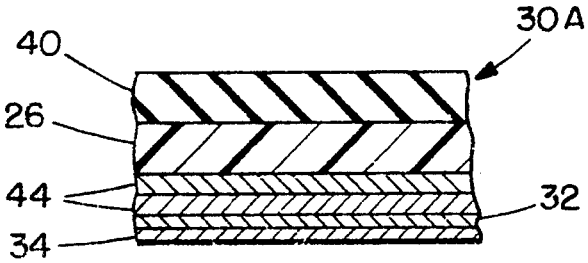
FIG. 7 is a cross section view, similar to FIG. 4, illustrating still another embodiment of the invention.

A modified sandwiched structure 30A is illustrated in FIG. 7. The structure 30A is similar to the sandwiched structure 30 of FIG. 4 with the exception of the addition of hook and loop fastening material 44 of the type sold under the trademark VELCRO ® marketed by Velcro Corporation of America which has offices in New York, N.Y. In this instance, one component of the hook and loop fastening material 44 can be semi-permanently attached to the handle 22 by means of the adhesive layer 32 while the other component remains integral with the foam pad 26. By reason of this construction, it may be possible to periodically remove a foam pad 26 when it has been worn to an extent that it no longer serves its intended function and then replace it with a new foam pad. As in the instance of the sandwiched structure 30, the modified sandwiched structure 30A may also provide for a rubber-like sheet 40 overlying the foam pad 26.

Figure 8:
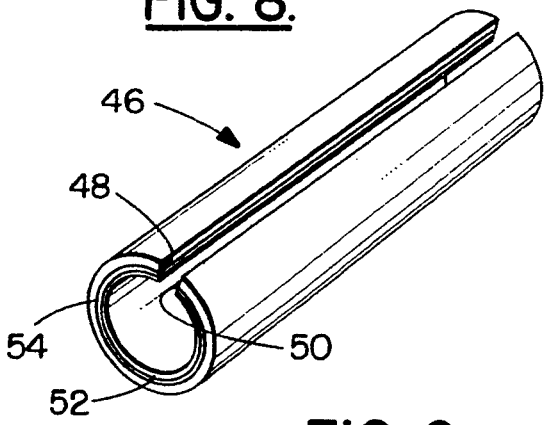
FIG. 8 is a perspective view of still a further embodiment of the invention.

Still another embodiment of the invention is illustrated in FIG. 8. In this instance, a further modified cushioned gripping device 46 is illustrated which is already tubular in shape, then cut lengthwise on one side to form opposed edges 48 and 50. When it is desired to attach the cushioned gripping device 46 to a handle 22, the edges 48 and 50 are drawn apart and a backing sheet 52, similar to the backing sheet 34, is removed to expose an adhesive layer 54 for pressure application to the surface of the handle. Unlike the situation when using the sandwiched structure 30, the cushioned gripping device 46 automatically aligns itself with a longitudinal axis of the handle 22.

Regardless of the particular embodiment, one or more of the cushioned gripping devices can be positioned at desirable locations along the length of the handle 22 in a custom manner to suit the user. The length of each cushioned gripping device can be chosen by the user as well as its placement on the handle. In addition, the user can also decide upon the number and spacing of the cushioned gripping devices to be attached along the length of the handle. A particular benefit of the invention resides in its ability to provide complete protection for the palm and fingers of the hand. Although the description has been directed to attachment of the cushioned gripping devices of the invention to the handle of a hand tool and, specifically, a shovel, such a use is not intended to be limiting of the invention. In actual fact, the invention may have many applications, including, but not limited to, uses on luggage handles, baseball bats, weightlifting bars, and a host of other types of apparatus.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A replaceable cushioned gripping device for releasable attachment to the elongated handle of a tool comprising:

a pad of foam-like resilient material dimensioned to substantially encircle the handle of the tool and being elongated to extend along a substantial length of the handle thereof, said pad having a continuously contoured outer surface such that when applied to the handle of the tool has a plurality of undulations which are longitudinally spaced along the length of the handle of the tool, each said undulation extending circumferentially of the handle of the tool, said undulations generally conforming to the fingers of a person's hand to improve the ability of the person to maintain a grip thereon when said pad is attached to the handle of the tool; and substantially planar attachment means including at least one additional layered component for selectively releasably mounting said pad to the handle of the tool.

2. A cushioned gripping device as set forth in claim 1 wherein said attachment means includes a layer of pressure sensitive adhesive material on said pad and generally coextensive therewith; and including:

a releasable backing sheet overlying and engaging said layer of adhesive material.

3. A cushioned gripping device as set forth in claim 1 wherein said attachment means includes hook and loop material having one component integral with said pad and generally coextensive therewith and another component capable of attachment to the handle of the tool.

4. A cushioned gripping device as set forth in claim 1 wherein said pad is tubular having an inner diameter substantially similar to the outer diameter of the handle of the tool and cut longitudinally to define opposed longitudinally extending edges which are drawn together into facing proximate relationship when said pad is attached to the handle of the tool.

5. A cushioned gripping device as set forth in claim 1 wherein said pad is generally planar and rectangular, having a width dimension generally equal to the circumference of the outer surface of the handle of the tool.

6. In combination with the elongated handle of a tool, a replaceable cushioned gripping device comprising:

a pad of foam-like resilient material dimensioned to substantially encircle said handle and being elongated to extend along a substantial length of said handle, said pad having a continuously contoured outer surface such that when applied to said handle has a plurality of undulations which are longitudinally spaced along the length of said handle, each said undulation extending circumferentially of said handle, said undulations generally conforming to the fingers of a person's hand to improve the ability of the person to maintain a grip thereon when said pad is attached to said handle; and substantially planar attachment means including at least one additional layered component for selectively releasably mounting said pad to said handle.

7. The combination as set forth in claim 6 wherein said attachment means includes a layer of pressure sensitive adhesive material on said pad and generally coextensive therewith; and including:

a releasable backing sheet overlying and engaging said layer of adhesive material.

8. The combination as set forth in claim 6 wherein said attachment means includes hook and loop material having one component integral with said pad and generally coextensive therewith and another component capable of attachment to said handle of said tool.

9. The combination as set forth in claim 6 wherein said pad is tubular having an inner diameter substantially similar to the outer diameter of said handle of said tool and cut longitudinally to define opposed longitudinally extending edges which are drawn together into facing proximate relationship when said pad is attached to said handle.

10. The combination as set forth in claim 6 wherein said pad is generally planar and rectangular, having a width dimension generally equal to the circumference of the outer surface of said handle of said tool.

* * * * *